US005321947A

United States Patent [19]

Sood et al.

[11] Patent Number: 5,321,947

[45] Date of Patent: Jun. 21, 1994

[54] LEAN PREMIX COMBUSTION SYSTEM HAVING REDUCED COMBUSTION PRESSURE OSCILLATION

[75] Inventors: Virendra M. Sood, Encinitas; Kenneth H. Maden, Coronado, both of Calif.

[73] Assignee: Solar Turbines Incorporated, San Diego, Calif.

[21] Appl. No.: 973,895

[22] Filed: Nov. 10, 1992

[51] Int. Cl.[5] ..... F23R 3/32

[52] U.S. Cl. ..... 60/737; 60/748

[58] Field of Search ..... 60/737, 733, 746, 742, 60/748, 752; 239/132, 132.3, 132.5

[56] References Cited

U.S. PATENT DOCUMENTS

| | | | |
|---|---|---|---|
| Re. 23,149 | 9/1949 | Lubbock et al. | 60/748 |
| 2,826,039 | 3/1958 | Ashwood | 60/752 |
| 3,713,588 | 1/1973 | Sharpe | 60/748 |
| 4,702,073 | 10/1987 | Melconian | 60/748 |
| 4,726,192 | 2/1988 | Willis et al. | 60/737 |
| 5,069,029 | 12/1991 | Kiroda et al. | 60/737 |
| 5,121,608 | 6/1992 | Willis et al. | 60/737 |

FOREIGN PATENT DOCUMENTS

| | | | |
|---|---|---|---|
| 0022127 | 1/1986 | Japan | 60/737 |
| 0119920 | 6/1986 | Japan | 60/747 |
| 0093210 | 4/1990 | Japan | 60/737 |
| 0183720 | 7/1990 | Japan | 60/737 |

OTHER PUBLICATIONS

Article entitled "Ongoing Development of a Low Emission Industrial Gas Turbine Combustion Chamber" published in the Journal of Engineering for Power, Jul. 1980, vol. 102, pp. 549-554 by V. M. Sood and J. R. Shekleton.

*Primary Examiner*—Richard A. Bertsch
*Assistant Examiner*—Timothy S. Thorpe
*Attorney, Agent, or Firm*—Larry G. Cain

[57] ABSTRACT

The lean premix combustion approach for NOx emissions control in gas turbine combustion systems has led to the problems of increased combustion pressure oscillation during engine operation and flame outs during rapid engine load reduction. Combustion pressure oscillation can reduce the durability of the engine and combustion system components to unacceptable levels. Flame outs can make the engine unacceptable from the operational viewpoint. The use of a control device allows the combustion pressure oscillation amplitude to be controlled to levels required for long durability of the combustion system components. It also allows an engine control system to operate the engine at part load condition and during rapid load reduction without flame out. When used at small levels, its effect on the engine NOx emissions is small. Higher levels may sometimes be needed to control the combustion pressure oscillation to acceptable levels. In such a situation, the penalty of increased NOx emissions has to be accepted in order to have an operationally acceptable engine.

8 Claims, 4 Drawing Sheets

LEAN PREMIX COMBUSTION SYSTEM HAVING REDUCED COMBUSTION PRESSURE OSCILLATION

TECHNICAL FIELD

This invention relates generally to gas turbine engines and more particularly to a device for controlling combustion pressure oscillation amplitude and flame out in lean premix combustion systems used for controlling NOx emissions.

BACKGROUND ART

The use of fossil fuel in gas turbine engines results in the combustion products consisting of carbon dioxide, water vapor, oxides of nitrogen, carbon monoxide, unburned hydrocarbons, oxides of sulfur and particulates. Of these above products, carbon dioxide and water vapor are generally not considered objectionable. In most applications, governmental imposed regulations are further restricting the remainder of the species, mentioned above, emitted in the exhaust gases.

The majority of the products of combustion emitted in the exhaust can be controlled by design modifications, cleanup of exhaust gases and/or regulating the quality of fuel used. For example, particulates in the engine exhaust have been controlled either by design modifications to the combustors and fuel injectors or by removing them by traps and filters. Sulfur oxides are normally controlled by the selection of fuels that are low in total sulfur. This leaves nitrogen oxides and unburned hydrocarbons as the emissions of primary concern in the exhaust gases emitted from the gas turbine engine.

The principal mechanism for the formation of oxides of nitrogen involves the direct oxidation of atmospheric nitrogen and oxygen. The rate of formation of oxides of nitrogen by this mechanism depends mostly upon the flame temperature and to some degree upon the concentration of the reactants. Consequently, a small reduction in flame temperature can result in a large reduction in the nitrogen oxides.

Past and some present systems providing means for reducing the maximum temperature in the combustion zone of a gas turbine combustor have included schemes for introducing more air into the primary combustion zone, recirculating cooled exhaust products into the combustion zone and injecting water spray into the combustion zone. An example of such a system is disclosed in U.S. Pat. No. 4,733,527 issued on Mar. 29, 1988, to Harry A. Kidd. The method and apparatus disclosed therein automatically maintains the NOx emissions at a substantially constant level during all ambient conditions and for no load to full load fuel flows. The water/fuel ratio is calculated for a substantially constant level of NOx emissions at the given operating conditions and, knowing the actual fuel flow to the gas turbine, a signal is generated representing the water metering valve position necessary to inject the proper water flow into the combustor to achieve the desired water/fuel ratio.

Another example of such a water injection system is disclosed in U.S. Pat. No. 4,483,137 issued on Nov. 20, 1984, to Robie L. Faulkner. The patent discloses introducing a liquid coolant into the combustor of the engine. This reduces the flame temperature in the combustor, thereby discouraging the formation of thermal NOx.

In an attempt to reduce NOx emissions without incurring increased operating costs caused by water injection, gas turbine combustion systems have utilized a lean premix approach. In use, experimentation has shown that such lean premix combustion can result in high combustion pressure oscillations and frequent flameouts in the gas turbine load range. The former can reduce the engine and combustion system durability to unacceptable levels while the latter can make the engine unacceptable for part load operation and rapid load reduction.

The above systems used therewith are examples of attempts to reduce the emissions of oxides of nitrogen. The use of water injection increases the operating costs due to the need for supplying water of high purity to the engine. In some applications, a supply of water is difficult to obtain. For example, in desert areas a water supply is basically non-existent, thus, the cost of operation is greatly increased. The operating costs are also increased due to the equipment such as lines, reservoirs and pump.

DISCLOSURE OF THE INVENTION

In one aspect of the invention, a gas turbine engine includes a central axis, a compressor section, a turbine section and a combustor section positioned operatively therebetween. The compressor section causes a flow of compressed air during operation of the gas turbine engine. The combustor section includes a combustor axis having an outer combustor housing coaxially positioned about the combustor axis and has a combustor coaxially aligned about the combustor axis. The combustor has a generally cylindrical outer shell coaxially positioned about the combustor axis and radially inwardly spaced from the outer combustor housing forming an air gallery therebetween. The outer shell has an outlet end portion and an inlet end portion having an inlet opening positioned near the inlet end portion and having a fuel injection nozzle positioned therein A plurality of swirler vanes are positioned in the inlet opening externally of the fuel injection nozzle and the plurality of swirler vanes have a preestablished space therebetween. A means for supplying a combustible fuel during normal operation of the engine and another means for supplying combustible fuel to the fuel injection nozzle generally along the combustor axis are included. The another means is used primarily for starting and part load operation of the engine wherein the combustible fuel includes between about 10 percent to 50 percent of the total combustible fuel directed to the engine. During normal operation of the engine at design point, the another means includes between about less than 1 percent to as high as 15 percent of the total combustible fuel directed to the engine.

BEST MODE FOR CARRYING OUT THE INVENTION

Figure 1:
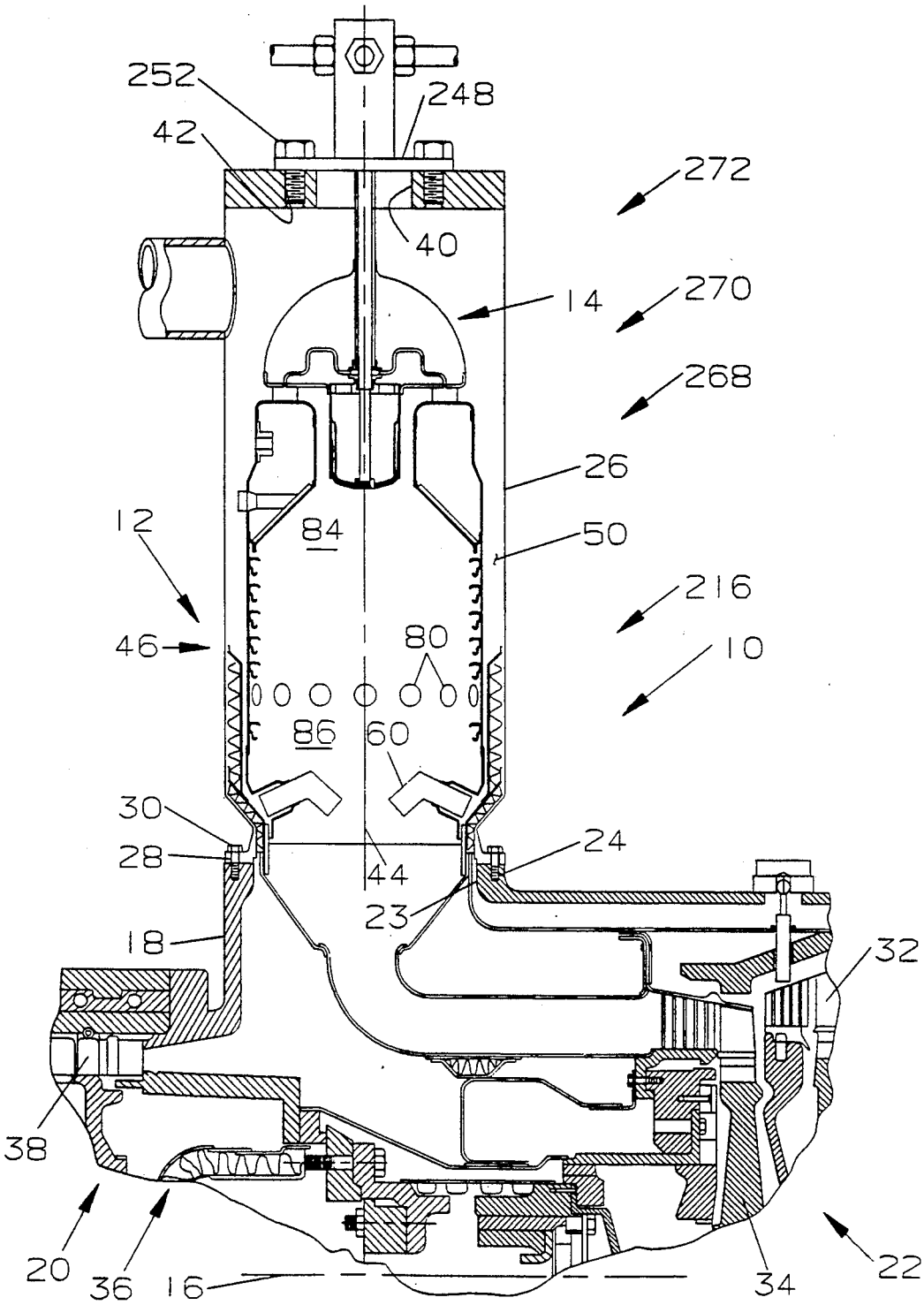
FIG. 1 is a partially sectioned side view of a gas turbine engine having an embodiment of the present invention.

In reference to FIG. 1, a gas turbine engine 10 having a side mounted combustor section 12 including a fuel injection nozzle 14 is shown. As an alternative to the side mounted combustor 12, any type of combustor such as an axial in line annular combustor or a plurality of can type combustors could be incorporated without changing the gist of the invention. The gas turbine engine 10 has a central axis 16 and an outer housing 18 coaxially positioned about the central axis 16. The housing 18 is positioned about a compressor section 20 centered about the axis 16 and a turbine section 22 centered about the axis 16. The combustor section 12 is positioned operatively between the compressor section 20 and the turbine section 22. Positioned within the housing 18 intermediate the compressor section 20 and the turbine section 22 is an opening 23 having a plurality of threaded holes 24 positioned therearound. An outer combustor housing 26, which is a part of the side mounted combustor section 12, has a plurality of holes 28 therein corresponding to the plurality of threaded holes 24 around the opening 23 and is positioned about the opening 23. A plurality of bolts 30 removably attach the combustor housing 26 to the outer housing 18.

The turbine section 22 includes a power turbine 32 having an output shaft, not shown, connected thereto for driving an accessory component such as a generator. Another portion of the turbine section 22 includes a gas producer turbine 34 connected in driving relationship to the compressor section 20. The compressor section 20, in this application, includes an axial staged compressor 36 having a plurality of rows of rotor assemblies 38, of which only one is shown. When the engine 10 is operating, the compressor 36 causes a flow of compressed air to be used for combustion and cooling. The compressed air is ducted to the side mounted combustor section 12 in a conventional manner. As an alternative, the compressor section 20 could include a radial compressor or any source for producing compressed air.

Figure 2:
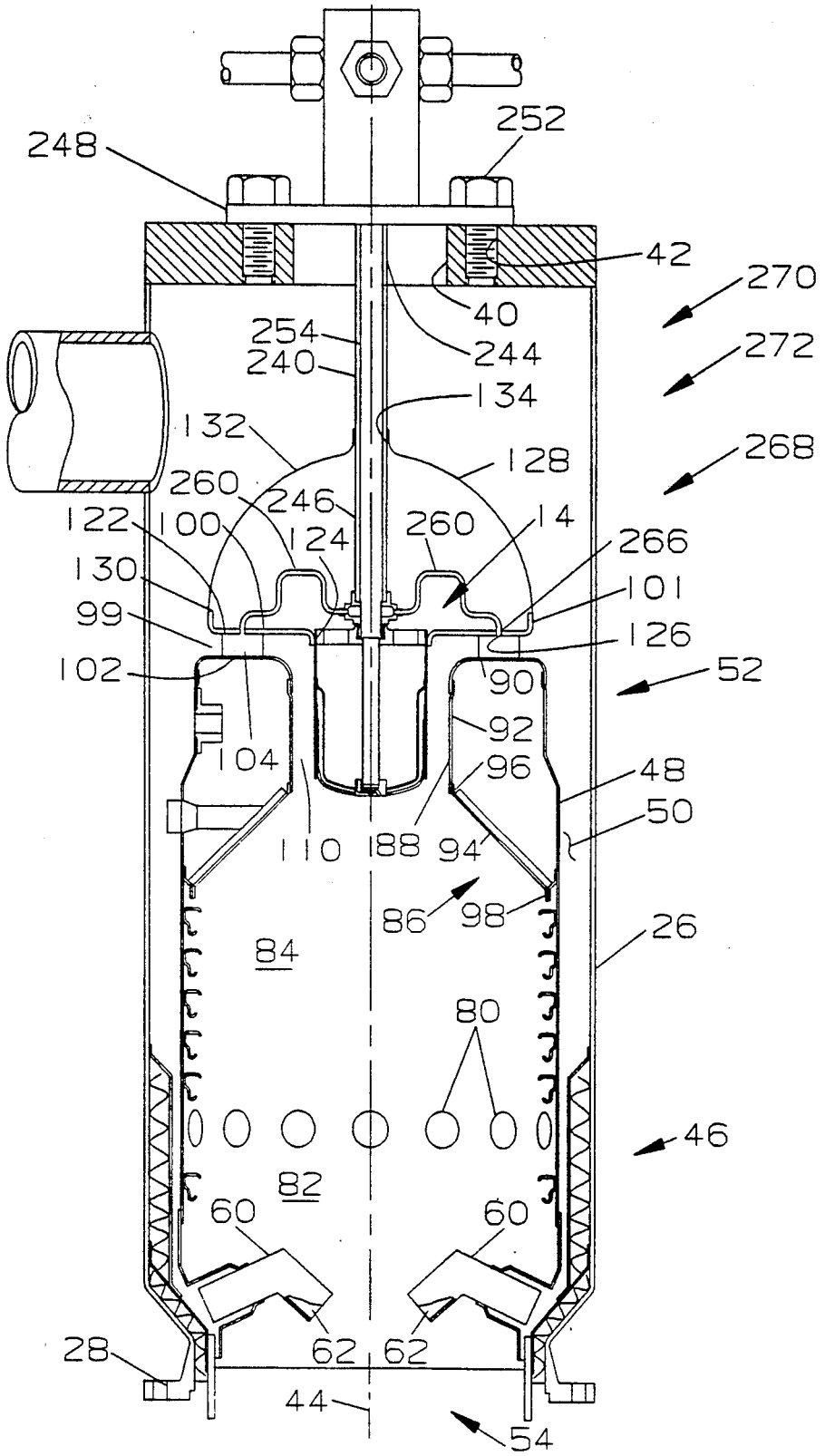
FIG. 2 is an enlarged sectional view of a combustor used in one embodiment of the present invention.

In this application and best shown in FIG. 2, the side mounted combustor section 12 includes the combustor housing 26 having an opening 40 therein and a plurality of threaded holes 42 positioned therearound. The combustor housing 26 is coaxially positioned about a combustor axis 44 being perpendicular to the central axis 16. The side mounted combustor section 12 further includes a can combustor 46 coaxially aligned about the combustor axis 44. The combustor 46 is supported from the outer combustor housing 26 in a conventional manner. The combustor 46 has a generally cylindrical outer shell 48 being coaxially positioned about the combustor axis 44 and radially spaced a preestablished distance from the outer combustor housing 26 forming an air gallery 50 therebetween. The outer shell 48 has an inlet end portion 52 and an outlet end portion 54. Positioned near the outlet end portion 54 is a plurality of tube assemblies 60. Each tube assembly 60 has a passage 62 therein being in fluid communication with the flow of cooling air from the air gallery 50. In this application, four tube assemblies 60 are employed. The tube assembly 60 further has an end directed toward the outlet end portion 54. A series of openings 80 are positioned within the outer shell 48 intermediate the inlet end portion 52 and the outlet end portion 54. In this application, twenty openings 80 are employed. A first chamber or dilution zone 82 is formed between the series of openings 80 and the outlet end portion 54 and a second chamber or primary zone 84 is formed between the series of openings 80 and the inlet end portion 52. Positioned radially inward of the outer shell 48 is a plate assembly 86 including an upside down "L" shaped cowling 88 having a short leg member 90 and a long leg member 92. An end of the short leg member 90 is attached to the outer shell 48 at the inlet end portion 52 and the other end of the short leg member 90 is attached to an end of the long leg member 92. Another end of the long leg member 92 is attached to a bevel ring member 94 at a first end 96 thereof and a second end 98 thereof is attached to the outer shell 48. Thus, the bevel ring member 94 is tapered from the leg member 92 outwardly toward the outlet end portion 54.

An inlet opening 99 is radially disposed between the short leg member 90 and a circular end plate 100. The circular end plate 100 includes an outer portion 101 positioned near its circumference. The circular end plate 100 is coaxially positioned about the combustor axis 44 and is in contacting relationship at the outer portion 101 with a plurality of swirler vanes 102 having a preestablished space 104 therebetween. The fuel injection nozzle 14 is positioned radially inward of the plurality of swirler vanes 102. The injection nozzle 14 is coaxially aligned with the combustor axis 44 and forms a generally axial cavity 110 between the injection nozzle 14 and the long leg member 92. An opening 124 in the plate 100 is positioned about the injection nozzle 14. A plurality of holes 126 within the plate 100 are circumferentially evenly spaced about the combustor axis 44 and are aligned to exit the plate 100 in the preestablished space 104 between the outer portion 101 between each of the plurality of swirler vanes 102. A cup shaped cover 128 including a lip portion 130 is attached to the plate 100 and includes a bowl portion 132 having an opening 134 therein. The lip portion 130 is attached near the outer periphery of the outer portion 101 of the end plate 100.

Figure 3:
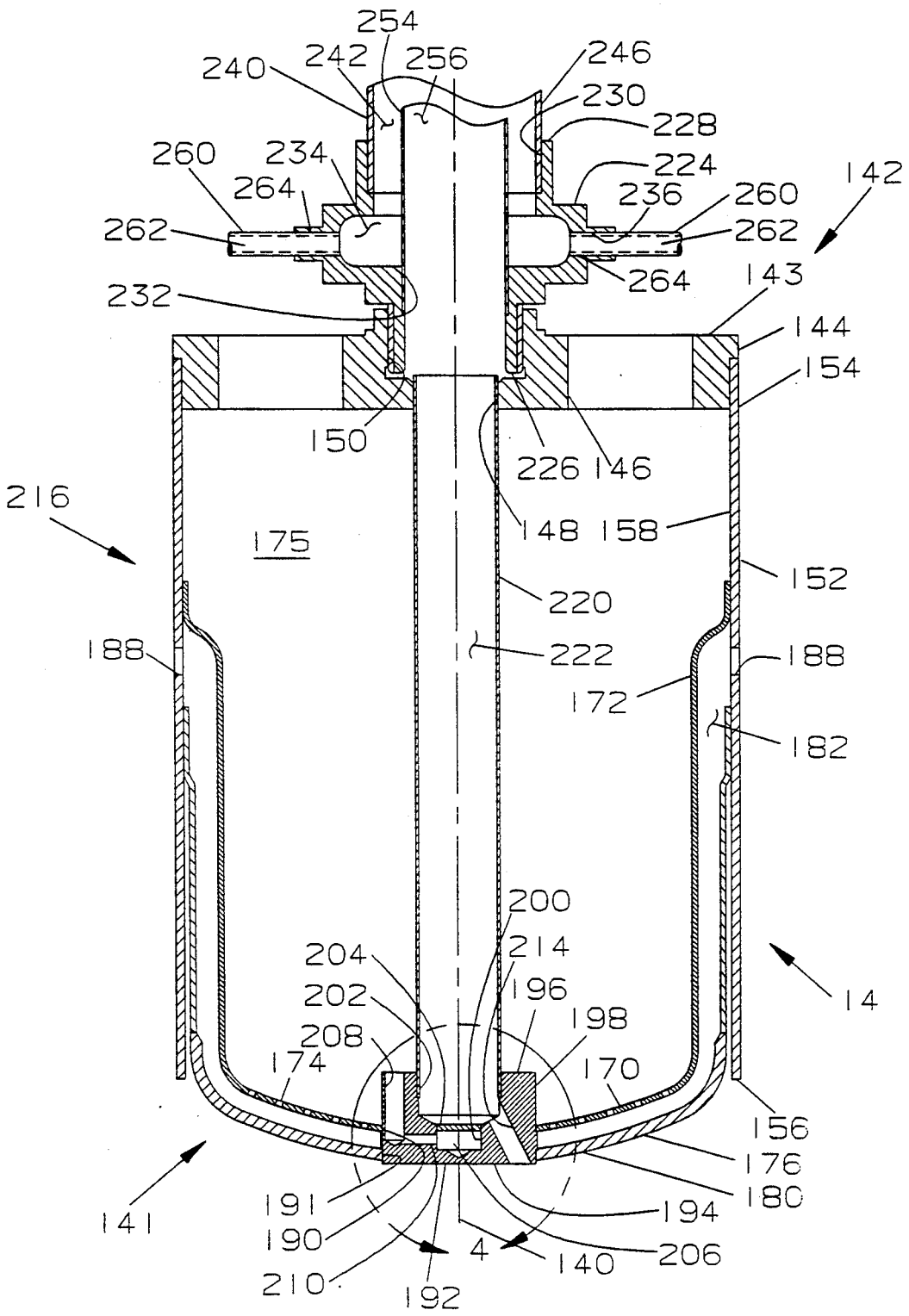
FIG. 3 is an enlarged sectional view of a fuel injection nozzle used in one embodiment of the present invention.

As best shown in FIG. 3, the fuel injection nozzle 14 has a nozzle axis 140 coaxial with the combustor axis 44 in the assembled position and is supported from the combustor housing 26 in a conventional manner, as will be explained later. The fuel injection nozzle 14 has a combustor end 141 and a generally closed inlet end 142, which in this application, includes a cylindrical backing plate 143 being coaxial with the nozzle axis 140. The plate 143 includes a stepped outer contour 144 and has a plurality of holes 146 evenly spaced and radially positioned about the nozzle axis 140. In this application, eight holes having a diameter of about 22.0 mm are used. A center hole 148 having a stepped surface 150 is positioned in the plate 143 and is centered about the nozzle axis 140. A cylindrical housing 152 having a first end portion 154, a second end portion 156 and an inner surface 158 is attached to the stepped outer contour 144 at the first end portion 152. A first member 170 being of a relatively thin material or skin, approximately 1.5 mm thick, has a generally cup shaped contour, and a generally cylindrical axial portion 172 having an expanded end attached to the inner surface 158 intermediate the first and second end portions 154,156. The first member 170 further has a generally radial end portion 173, which in this application is generally spherical, attached to the other end of the cylindrical axial portion 172. The end portion 173 has a plurality of holes 174 therein. Formed between the first member 170, the inner surface 158 of the cylindrical housing and the backing plate 143 is a cooling reservoir 175. A second member 176 being of a relative thin material or skin but greater than the first member 170, approximately 3.0 mm thick, has a generally cup shaped contour, includes a generally cylindrical axial portion 178 having an expanded end attached to the inner surface 158 intermediate the second end portion 156 and the first member 170. A radial end portion 180 having a generally spherical configuration is attached to the other end of the cylindrical axial portion 178. Thus, the position of the first member 170 relative to the second member 176 and a portion of the inner surface 158 of the cylindrical housing 154 has a preestablished spaced distance therebetween which forms a cooling passage 182. Positioned in the housing 154 intermediate the expanded ends of the first member 170 and the second member 176 is a plurality of passages 188 which provides communication from the cooling passage 182 through the housing 154 into the axial cavity 110. In this application, sixteen (16) passages 188 having approximately a 6.86 mm diameter are equally positioned in the cylindrical housing 154 about its perimeter. Each of the first and second members 170,176 has an opening 190,191 respectively centrally positioned in the respective end portions 173,180. A tip 192 is positioned in the openings 190,191, is coaxial with the nozzle axis 140, is attached to the second member 176 and is in contact with the opening 190 in the first member 170.

Figure 4:
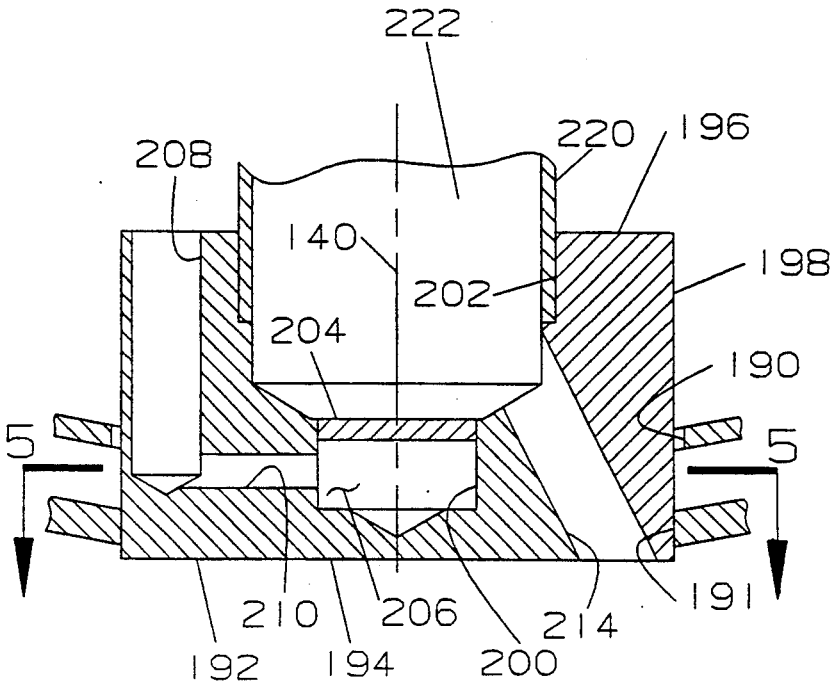
FIG. 4 is an enlarged sectional view of a tip of the fuel injection nozzle taken within line 4 of FIG. 3.
Figure 5:
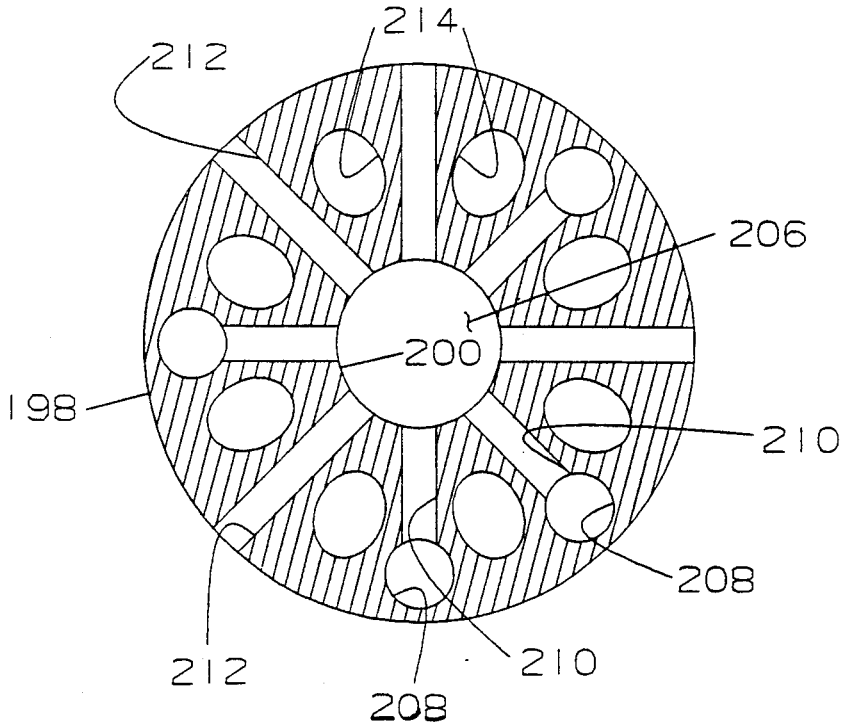
FIG. 5 is an enlarged sectional view of the tip taken along lines 5—5 of FIG. 4.

As best shown in FIG. 3, 4 and 5, the tip 192 has a generally cylindrical shape having a combustor face 194, a back face 196 and an outer surface 198 extending between the combustor face 194 and the back face 196. The tip 192 has a first central bore 200 entering the back face 196 and has a predetermined depth which bottoms within the tip 192. A second central bore 202 being larger than the first central bore 200 enters the back face 196, is coaxial with the first central bore 200 and has a predetermined depth which bottoms short of the bottom of the first central bore 200. A plate 204 is positioned in the first central bore 200 and sealing forms a chamber 206. The tip 192 further includes a plurality of passages 208, only one shown, entering through the back face 196, radially spaced from the nozzle axis 140 and has a predetermined depth which bottoms within the tip 192 between the back face 196 and the combustor face 194. Each of the plurality of passages 208 is in communication with the first central bore 200 by way of a radial bore 210 which intersects with a corresponding one of the plurality of passages 208. The cooling passage 182 is in communication with the chamber 206 by way of a plurality of radial passages 212, as best shown in FIG. 5. The passages 212 pass through the outer surface 198 and intersect the chamber 206. In this application, the plurality of passages 208 include four passages 208 having about a 1.83 mm diameter and the plurality of radial bores 210 include four bores 210 having about a 0.82 mm diameter.

The radial passages 212 include four passages 212 having about a 0.82 mm diameter. Thus, a communication path is established from the cooling reservoir 175, through the tip 192 to the cooling passage 182. A plurality of angled passages 214 are evenly spaced along the combustor face 194 near the outer surface 198 and extend into the second central bore 202. In this application, the angled passages 214 include eight angled passages 214 angled at about 30 degrees to the nozzle axis 140 and have about a 1.81 diameter.

A means 216 for communicating a flow of cooling fluid through the cooling passage 182 includes a first flow path through the plurality of holes 146 in the plate 143, the cooling reservoir 175, the plurality of passages 208 in the tip, the radial bores 210, the chamber 206, the plurality of radial passages 212 and the plurality of passages 188 in the housing 154. The means 216 for communicating a flow of cooling fluid through the cooling passage 182 further includes a second flow path through the plurality of holes 146 in the plate 143, the cooling reservoir 175, the plurality of holes 174 in the end portion 173 and the plurality of passages 188 in the housing 154.

As best shown in FIG. 3, attached within the second central bore 202 of the tip 192 and the center hole 148 in the plate 143 is a tubular member 220 having a passage 222 therein. A manifold 224 having a nozzle end portion 226 is positioned in a portion of the stepped inner surface 150 and is sealingly attached thereto. A supply end portion 228 of the manifold 224 has a large bore 230 and a smaller bore 232 therein. A reservoir 234 is positioned in the manifold 224 intermediate the nozzle end portion 226 and the supply end portion 228. A plurality of openings 236 are evenly circumferentially spaced about the reservoir 234.

As stated above and best shown in FIGS. 2 and 3, the conventional manner in which the fuel injector nozzle 14 is attached includes an outer tubular member 240 having a passage 242 therein. The outer tubular member 240 includes an inlet end portion 244 and an outlet end portion 246 sealingly attached in the bore 230. The outer tubular member 240 extends axially through the opening 40 in the outer combustor housing 26 and has a mounting flange 248 extending therefrom. The flange 248 has a plurality of holes therein, not shown, in which a plurality of bolts 252 threadedly attach to the threaded holes 42 in the outer combustor housing 26. Thus, the injector 14 is removably attached to the outer combustor housing 26. The passage 242 is in fluid communication with a source of fuel, not shown. Coaxially positioned within the passage 242 is an inner tubular member 254 having an end attached within the passage 232. A passage 256 within the inner tubular member 254 communicates with a source of fuel and the plurality of angled passages 214 in the tip 192 by way of the passage 222 within the tubular member 220.

A plurality of tubes 260 each having a passage 262 therein and a first end 264 is attached in respective ones of the plurality of openings 236 and a second end 266 is attached in respective ones of the plurality of holes 126 in the circular end plate 100. The tubes 260 thus, communicate between the reservoir 234 and the respective space 104 formed between the swirler vanes 102. In this application, there are a total of twenty swirler vanes 102 and twenty tubes 260 interspersed therebetween. As an alternative, any combination of tubes 260 relative to the spaces 104 between the plurality of swirler vanes 102 could be workable.

A means 268 for supplying combustible fuel to the fuel injection nozzle 14 includes two separate paths; one being a means 270 for supplying combustible fuel into each of the spaces 104 between the swirler vanes 102 and another means 272 for supplying combustible fuel to the fuel injection nozzle 14 generally along the combustion axis 140. As an alternative, fuel could be supplied to only a portion of the spaces 104 between the swirler vanes 102 without changing the gist of the invention. The means 270 for supplying combustible fuel to the fuel injection nozzle 14 into each of the spaces 104 between the swirler vanes 102 includes the source of fuel and a pump and control mechanism (not shown), the passage 242 in the outer tubular member 240, the reservoir 234, the passage 262 in each of the plurality of tubes 260 and each of the plurality of holes 126. The another means 272 for supplying combustible fuel to the fuel injection nozzle 14 generally along the combustion axis 140 includes the source of fuel and a pump and control mechanism of conventional design (not shown), the passage 256 in the inner tubular member 154, the passage 222 in the tubular member 220 and the plurality of angled passages 214 in the tip 192.

Industrial Applicability

In use, the gas turbine engine 10 is started in a conventional manner. Gaseous fuel used for pilot fuel, which in this application is between about 10 percent and 50 percent of the total fuel, during starting is introduced through the passage 222 into the primary zone 84. Further, fuel is introduced through the passage 256 and exits into the plurality of spaces 104 by way of the passages 262 and the holes 126. Combustion air from the compressor section 20 is introduced through the inlet opening 99 into the plurality of spaces 104, mixed with the fuel within the spaces 104 which are radial to the central axis 44, further mixes and passes along the generally axial cavity 110 before exiting into the primary zone 84 wherein the pilot fuel from the passage 222 further mixes with the mixed fuel and air from the cavity 110 and combustion occurs.

As the engine 10 is accelerated, additional fuel and air is added to the spaces 104 and the proportion of pilot fuel is decreased. More combustion air passes through each of the spaces 104 between the plurality of swirler vanes 102 and more fuel is added to the combustion air. For example, additional fuel is introduced through the passage 242 and into the reservoir 234, passes through the plurality of passages 262, exits the hole 126 and mixes with the combustion air within the spaces 104 between each of the swirler vanes 102 which are located at the radial inlet opening 99 and then on to the downstream cavity 110. Thus, a highly homogeneous mixture is established prior to entering the combustion chamber and primary zone 84. In many competitive gas turbine engine operations, the pilot fuel is discontinued after initial starting. The temperature within the primary zone is in the range of from about 1800 degrees to 2600 degrees Fahrenheit. As the hot reacted gases exit the primary zone 84, additional combustion air is introduced through the series of openings 80, mixes with the hot reacted gases to bring down their temperature within the dilution zone 82. Thus, the combustion temperature within the dilution zone 82 ranges between about 1500 degrees and 2000 degrees Fahrenheit. To ensure a reduction of the combustion gas temperature to meet the requirement of the gas turbine engine 10 additional air is introduced through the tube assemblies 60. For example, air from the compressor section 20 passes through the air gallery 50 into the passage 62 within each of the tube assemblies 60. The air exits the passage 62 near an end and is directed toward the outlet end portion 54 to mix and cool the mixed gases further, prior to entering the turbine section 22. Thus, the temperature of the mixed gases is controlled to meet the requirement of the gas turbine engine 10 preventing unnecessary deterioration and premature failure of components parts.

During the steady state operation of the gas turbine engine 10 combustion pressure oscillation can be set up which can cause premature failure of the component parts and unscheduled engine 10 maintenance, such as engine 10 shutdown. Furthermore, during off load transients when a sudden reduction in fuel flow is required to control the engine overspeed, flame out of the engine can occur. To overcome this phenomena, it has been found that if between less than 1 percent and about 15 percent of the total fuel consumed by the engine 10 is continually introduced into the combustor, by means 272, combustion pressure oscillation and flame out conditions can be reduced to an acceptable level. It was initially thought that a continuous supply of pilot fuel would increase the pollution level emitted from the engine exhaust to such an extent that governmental imposed levels could not be maintained. However, further investigation and experimentation has shown that the pollutants, primarily oxides of nitrogen, are increased as the level or percent of fuel supplied by means 272 is increased. This increase is, however, not significant so that overall levels of oxides of nitrogen within the preestablished pollution level can be achieved. Thus, if the quantity of pilot fuel is retained within the limits of between less than 1 percent to about 15 percent, and in this application more explicitly between 3 percent and 5 percent, the pollution level can be maintained below preestablished levels and the combustion pressure oscillation and flame out are reduced to an acceptable level.

As mentioned above, the temperature within the primary zone 84 is in the range of between about 1800 to 2600 degrees Fahrenheit. Thus, the end of the injector 14 in contact with the combustion gasses must be cooled to prevent erosion and premature failure. For example, cooling air enters the injector 14 through the plurality of holes 146 and fills the cooling reservoir 175. The means 216 provides internal cooling of the combustor end 141 using compressed air from the compressor section 20 and incorporates a twofold path through which cooling air can exit the cooling passage 182 and provide cooling to the end portion 180 of the second member 176 and the tip 192. The first flow path is intended to primarily cool the tip 192 and further cool the end portion 180; the second flow path is intended to ensure primary cooling of the end portion 180. The first flow path allows cooling air from the reservoir 175 to enter the plurality of passages 208 in the tip 192 and the chamber 206. From the chamber 206, the cooling air exits the plurality of radial passages 212 enters the cooling passage 182 and exits through the plurality of passages 188 into the cavity 110. The second flow path allows cooling air from the reservoir 175 to enter through the plurality of holes 174 into the cooling passage 182 and exits through the plurality of passages 188 into the cavity 110.

Reduced pollution has resulted in gas turbine engines 10 by using the above described injector 14 in conjunction with the lean premix system. Low NOx is maintained by supplying combustible fuel into each of a plurality of spaces 104 formed between the swirler vanes 102. Combustion pressure oscillation is reduce to a workable level by continually supplying pilot fuel to the combustor 26 during all operating conditions of the engine 10.

The present system or structure for cooling a combustion end of a fuel injection nozzle 14 is accomplished by providing a cooling passage 182 for skin cooling of the portion of the nozzle 14 exposed most directly to the combustion flames. The combustor end of the fuel injection nozzle 14 is maintained at a temperature low enough to prevent failure of the combustor end through oxidation, cracking and buckling.

Other aspects, objects and advantages will become apparent from a study of the specification, drawings and appended claims.

We claim:

1. A gas turbine engine including a central axis, a compressor section coaxially positioned about said central axis, a turbine section coaxially positioned about said central axis and a combustor section positioned operatively therebetween;

said combustor section including a combustor axis and having an outer combustor housing coaxially positioned about the combustor axis and having a combustor disposed inwardly of the outer combustor housing and coaxially aligned about the combustor axis;

said combustor having a generally cylindrical outer shell being coaxially positioned about the combustor axis and being radially inwardly spaced from the outer combustor housing forming an air gallery therebetween;

said outer shell having an outlet end portion and an inlet end portion having an inlet opening being positioned therein and having fuel injection nozzle positioned therein;

a plurality of radial swirler vanes being positioned in the inlet opening externally of the fuel injection nozzle and said plurality of radial swirler vanes having a preestablished space therebetween, said plurality of radial swirler vanes being radially positioned about the fuel injection nozzle;

means for supplying a combustible fuel to the combustor said means for supplying a combustible fuel to the combustor having an exit being positioned between at least a portion of the swirler vanes in the preestablished spaces and during operation of the gas turbine engine combustion air from the compressor section is introduced through the inlet opening into the plurality of spaces, mixed with the combustible fuel within the spaces which are radial to the combustion axis and further mixes and passes along a generally axial cavity before exiting into the combustor; and another means for supplying combustible fuel to the fuel injection nozzle being in communication with the fuel injection nozzle.

2. The gas turbine engine of claim 1 wherein the combustor outer shell defines a series of openings positioned intermediate the inlet end portion and the outlet end portion of the outer shell, said series of openings separating a primary zone near the inlet end portion from a dilution zone near the outlet end portion.

3. The gas turbine engine of claim 2 wherein said outer shell further defines a plurality of openings positioned near the outlet end portion and each of said plurality of openings have a tube assembly positioned therein.

4. The gas turbine engine of claim 3 wherein said tube assembly includes a passage therein being in communication with the flow of compressed air and an end being directed toward the outlet end portion.

5. The gas turbine engine of claim 1 wherein said means for supplying combustible fuel to the combustor supplies fuel into each of the spaces between the plurality of swirler vanes.

6. The gas turbine engine of claim 1 wherein said fuel injection nozzle includes a combustor end having a member being cooled internally.

7. The gas turbine engine of claim 6 wherein said compressor section causing a flow of compressed air during operation of the gas turbine engine; and said internal cooling uses compressed air from said compressor section.

8. The gas turbine engine of claim 7 wherein said engine further includes a cavity formed between the fuel injection nozzle and the combustor and means wherein said compressed air after internally cooling the combustor end is communicated into the mixture of air and fuel exiting the space between the plurality of swirler vanes within the cavity.

* * * * *